US008381875B2

(12) United States Patent
Leng

(10) Patent No.: US 8,381,875 B2
(45) Date of Patent: Feb. 26, 2013

(54) LAMBDOIDAL LADDER

(75) Inventor: Luhao Leng, Fujian (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 12/671,077

(22) PCT Filed: Oct. 27, 2008

(86) PCT No.: PCT/CN2008/072846

§ 371 (c)(1),
(2), (4) Date: Jan. 28, 2010

(87) PCT Pub. No.: WO2009/129680

PCT Pub. Date: Oct. 29, 2009

(65) Prior Publication Data

US 2011/0024232 A1 Feb. 3, 2011

(30) Foreign Application Priority Data

Apr. 24, 2008 (CN) ..... 2008 2 0102113 U
Apr. 24, 2008 (CN) ..... 2008 2 0102114 U

(51) Int. Cl.
*E06C 1/00* (2006.01)
*E06C 7/08* (2006.01)

(52) U.S. Cl. ..... 182/116; 182/156; 182/180.1; 182/228.3

(58) Field of Classification Search ..... 182/165, 182/25, 176, 116, 119, 120, 156, 179.1, 180.1, 182/228.3, 228.4
See application file for complete search history.

(56) References Cited

U.S. PATENT DOCUMENTS

| | | | | | |
|---|---|---|---|---|---|
| 1,019,444 | A * | 3/1912 | Erskine | 182/166 |
| 1,942,849 | A * | 1/1934 | Thrasher | 182/165 |
| 2,109,886 | A * | 3/1938 | Lewis | 182/124 |
| 2,364,048 | A * | 12/1944 | Barkey | 182/172 |
| 5,366,052 | A | 11/1994 | Keh-Lin | |
| 5,971,102 | A * | 10/1999 | Brown | 182/129 |
| 6,698,548 | B1 * | 3/2004 | Verrill | 182/129 |
| 6,892,860 | B2 * | 5/2005 | Gibson et al. | 182/222 |
| 2004/0231920 | A1 * | 11/2004 | Meeker | 182/165 |
| 2007/0181369 | A1 * | 8/2007 | Gibson et al. | 182/165 |

FOREIGN PATENT DOCUMENTS

| | | |
|---|---|---|
| CN | 2317304 Y | 5/1999 |
| CN | 2821124 Y | 9/2006 |
| CN | 2854041 Y | 1/2007 |

* cited by examiner

*Primary Examiner* — Alvin Chin Shue
*Assistant Examiner* — Daniel Cahn
(74) *Attorney, Agent, or Firm* — Rabin & Berdo, P.C.

(57) ABSTRACT

A lambdoidal ladder comprises front struts (100), back struts (200), treads (500), a folding device) 400, a connection device (600) and a platform (300). Wherein the platform (300) is connected to the front strut (100) and the back strut (200), and the structure between the front strut and the back strut is a rotatable connection; the platform (300) comprises a body (310) and a transverse rod (320) which goes through the front strut (100), an orientation slot (314) matching to the transverse rod (320) is set under the body (310); the folding device (400) fixed to the middle part of the front strut and the back strut is constructed a hinge with a H figuration; the tread (500) is fixed to the front and back struts by the connection device (600).

11 Claims, 10 Drawing Sheets

LAMBDOIDAL LADDER

FIELD OF THE INVENTION

The present invention relates to a lambdoidal ladder, more particularly, to a foldable lambdoidal ladder.

BACKGROUND OF THE INVENTION

The foldable lambdoidal ladder of the prior art comprises front struts, back struts, treads, a folding device and a platform. The platform is a plastic parts directly and pivotally connected to tops of the front struts and back struts, which make the structure between the front strut and the back strut be a rotatable connection. The platform of the lambdoidal is functioned as: 1, connecting the front struts with the bake struts, 2, be a platform in working. Because the plastic parts directly and pivotally connected to the front struts and the back struts, thus it has the following drawbacks: firstly, the connection strength is not strong enough to be a working platform; secondly, the plastic parts pivotally connected both to the front struts and the back struts, which is not convenient in assembly.

And the connection structure between the struts and the treads of the lambdoidal ladder generally have the following two forms: the first one is to lock the strut and the tread by a locking element directly; the second one is to set through holes in the strut, then the ends of the treads inserted into the holes to be locked. The first connection structure has the following drawbacks: firstly, the cut force generated between the tread and the strut is forced entirely on the locking element, therefore the locking member is easy to be broken, and has short use time and lower use safety; secondly, the tread of the prior art generally is hollow structure, therefore, the locking member must locked inside the hollow tread, this is not convenient in locking or assembly; thirdly, the tread may be rotated in use thus the use safety is not enough. The second connecting structure has the following drawbacks: firstly, through holes are set in the struts, thus lower the strength of the struts, if the strength is to be enhanced, it must add the sectional area of the struts or use solid structure, which will add the amount of the material and add the cost of production; secondly, the structure of the treads of the prior art are mostly hollow, the locking member is locked inside the hollow tread, thus both the locking and the assembly are not convenient.

SUMMARY OF THE INVENTION

The primary object of the present invention is to provide a lambdoidal ladder which obviates the disadvantage of the lambdoidal ladder of the prior art that the platform is not strong enough in connection and is not strong enough as a working platform.

Another object of the present invention is to provide a lambdoidal ladder which obviates disadvantage of the lambdoidal ladder of the prior art that the treads are not strong enough in connection.

A further object of the present invention is to provide a lambdoidal ladder which obviates disadvantage of the lambdoidal ladder of the prior art that the folding device is not strong enough.

Solution 1

A lambdoidal ladder comprises front struts, back struts, treads, a folding device, a connection device and a platform; the platform is connected to the front strut and the back strut, and the structure between the front strut and the back strut is a rotatable connection; the platform comprises a body and a transverse rod which goes through the front strut, an orientation slot matching to the transverse rod is set under the body; wherein said body is connected to said front struts, and the orientation slot of the body is supported on the transverse rod; the folding device fixed to the middle part of the front strut and the back strut is constructed a hinge with a H figuration; the tread is fixed to the front and back struts by the connection device.

A plurality of reinforcement ribs which arranged spaced and parallel are formed under said body, grooves matching with said transverse rod are upwardly formed under said reinforcement ribs, said grooves are arranged lengthwise so as to form the orientation grooves matching to the transverse rod.

Or a lengthwise orientation bar and a plurality of reinforcement ribs which arranged spaced and parallel are formed under said body, said orientation bar is crossly connected with said reinforcement ribs, and a orientation groove matching to the transverse rod is set under the orientation bar.

The edge of said body is extended downwardly to form a periphery, herein said body connected to said front struts, said periphery sleeved on the top ends of said struts, and the transverse rod is gone through said front struts and connected to said periphery.

Said H-shaped hinge comprises a transverse rod, a pair of front vertical rods and a pair of rear vertical rods; said rear vertical rods are U-shaped rods, the rear ends of said front vertical rods are inserted into said rear vertical rods; the front ends of said front vertical rods are fixed to the outside of the two front struts; the rear ends of two rear vertical rods are fixed to the outside of the two rear struts; the vertical rod is fixed between the two front vertical rods.

Said connection device comprises: a connection element, the outside of said connection element is sleeved to the top end of said tread, the inner side of said connection element is connected to the struts and is locked to said connection element by a locking element passing through the strut.

Said connection element comprises a middle piece, an insertion portion and a protrusion portion, said insertion portion and said protrusion portion are respectively fixed to the front and rear of said middle piece, herein the insertion portion is matching to and inserted to the inner side of said hollow strut; a lengthwise groove is disposed in the strut, said lengthwise groove is fixedly connected to the protrusion of said connection element.

Said connection element is an integrated structure, the front side of said middle piece is fixed to the rear side of said insertion portion, said middle piece is provided with a front protrusion which is extended out said insertion portion; herein said insertion portion is inserted into the inner side of said hollow strut, said front extending side is abut against the opening of said hollow tread.

The back side of said middle piece is fixed with said protrusion portion, said middle piece is provided with a back extending side which is extended out said protrusion portion; herein said protrusion portion is inserted into the lengthwise groove of said strut, said back extending side is abut against said strut, said protrusion is matching to the bar-shaped protrusion of said lengthwise groove.

Another Solution

The front side of said connection element is provided with a orientation groove, the inner edge of said connection element is matching to the outer edge of the section of said tread, the end portion of said tread is positioned and supported inside said orientation groove, said connection element is fixed to the strut.

Said connection element comprises a base and two protrusions respectively disposed to the left side and right side of said base, said orientation groove is positioned on said base, said two protrusions are extended to the rear of said base, herein the rear side of said base is fixed and abut against to the first side of the strut, said two protrusions are respectively abut against two second sides which are next to the first side of the strut.

The abut connection between said protrusion and strut is a tight abut connection.

The first side of said strut is concaved to form a middle groove, said base is protruded backwardly to form a middle element, said middle element is disposed inside of said middle element and they are tight fit.

Compared with the prior art, the platform comprises a body and a transverse rod, the body is supported by the transverse rod, resulting in a strong platform. As the transverse rod is connected to the front struts, the platform is connected to the front struts via the transverse rod, thus the connection between the platform and the front struts is strong. The body may be provided with an orientation groove, the orientation groove is supported above the transverse rod, thus the orientation is accurate, and the stability for the support is increased. The body may be formed with reinforcement ribs, which facilitates the manufacturing process and increases structural strength. The reinforcement ribs may be provided with orientation slots, the support between the transverse rod and the body has accurate orientation. The reinforcement ribs may be provided with orientation bars below, and the orientation bars may be provided with grooves, thus the strength of the body can be increased, and the support between the transverse rod and body are also increased. The periphery may be sleeved to the top ends of the front struts, thus enhancing the appearance. The transverse rod passes through the top ends of the front struts and connected to the periphery, thereby providing a stable and reliable connection and with high supporting strength. The rear struts are also located inside the periphery, thus providing a pleasing appearance. The orientation bar is fixed to the periphery, and may be unitary formed, thus providing a high strength connection. Moreover, the treads are connected to the leg pipes of the struts via the connection elements, the outside of the connection elements is fixed to the leg pipe, the inner side is sleeved to the end portion of the treads, thus the leg pipe had no through holes, and the end portion of hollow treads is sleeved to the connection element, which increases the contacting area to the leg pipe, the strength is enhanced. The folding device is adapted to be H-shaped hinge, the folding and unfolding are more convenient, and is more stable in use.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

Figure 1:
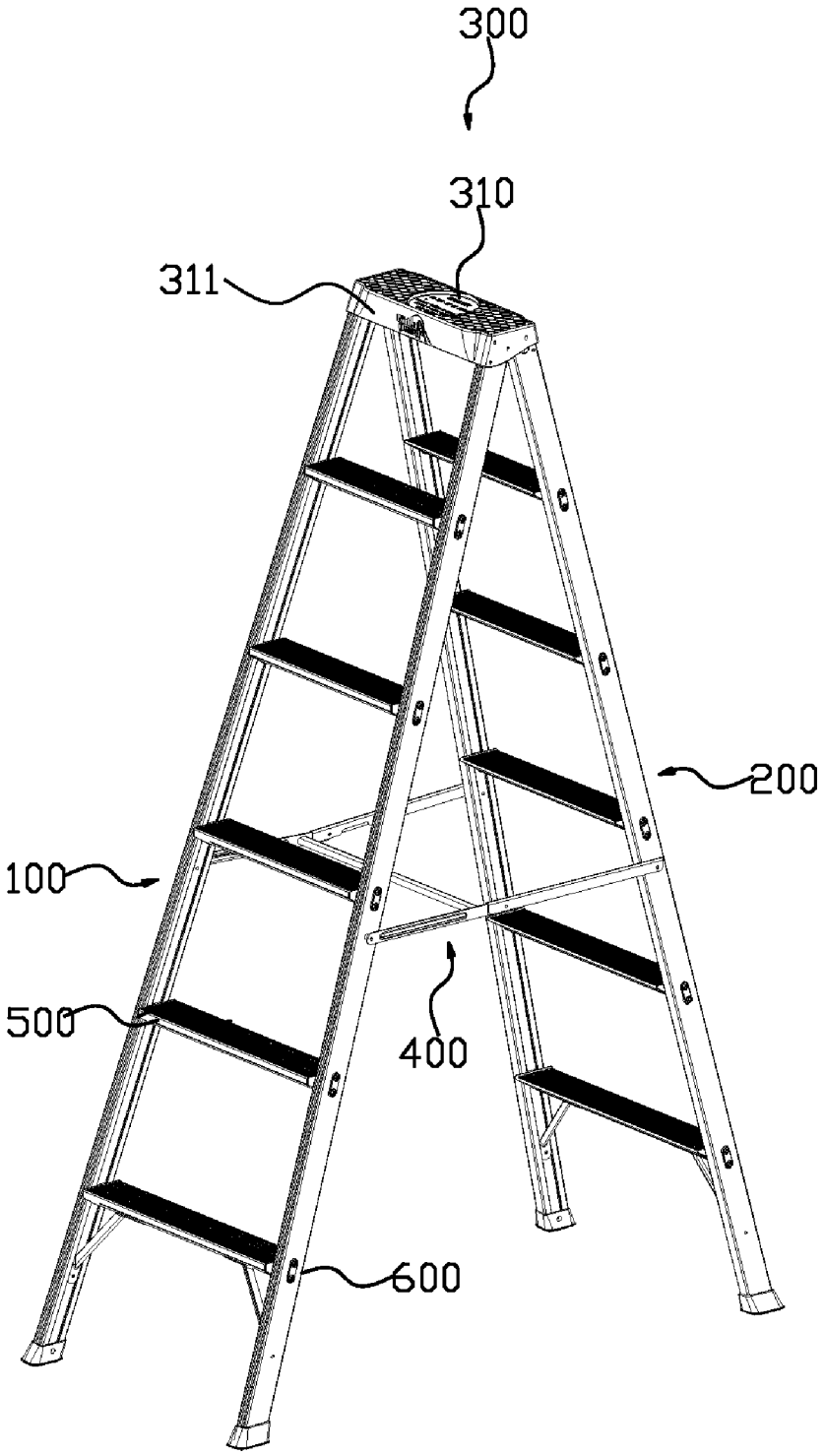
FIG. 1 is a perspective view of the embodiment 1 of the present invention.
Figure 2:
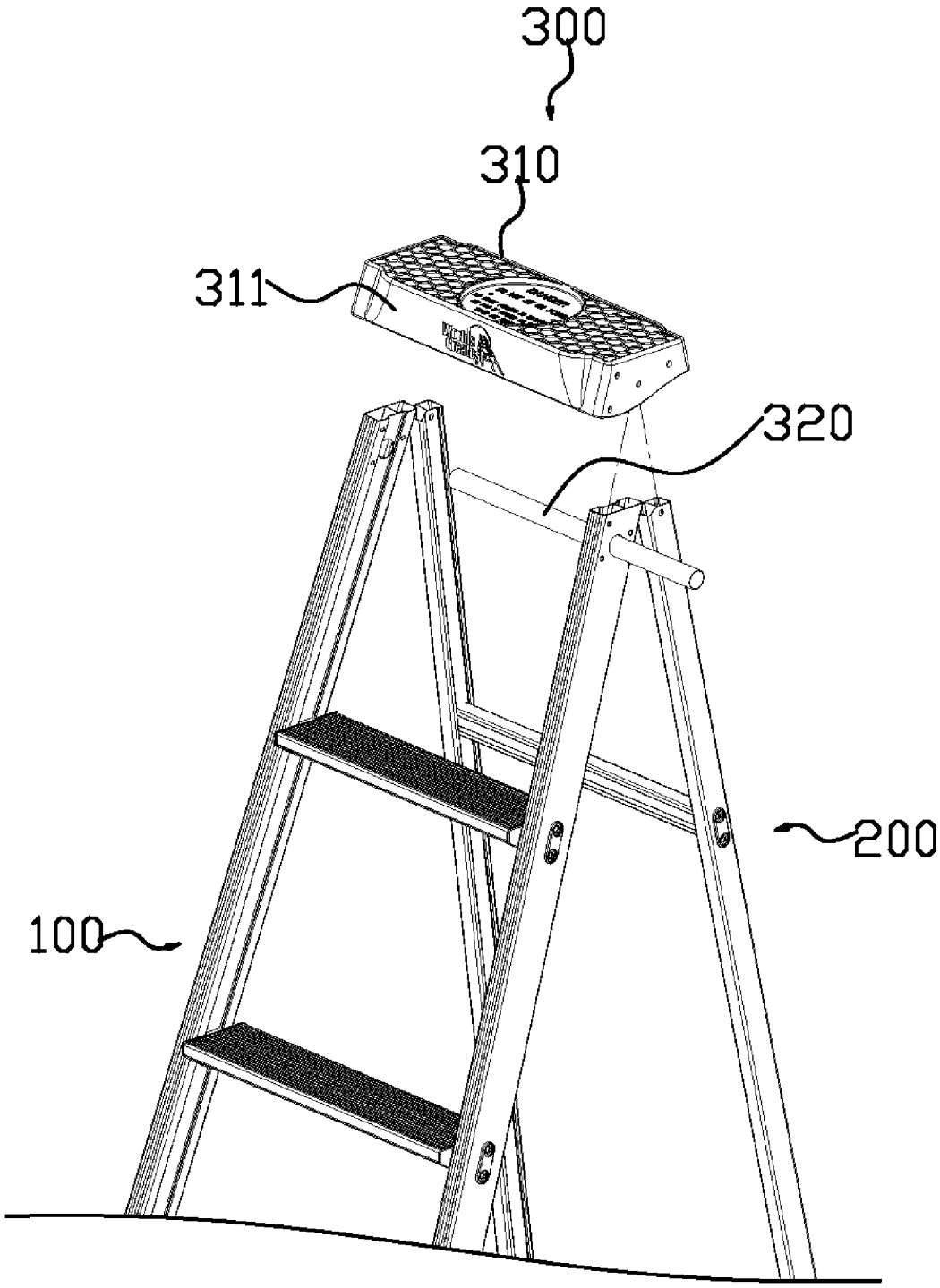
FIG. 2 is an exploded view of the embodiment 1 of the present invention.
Figure 3:
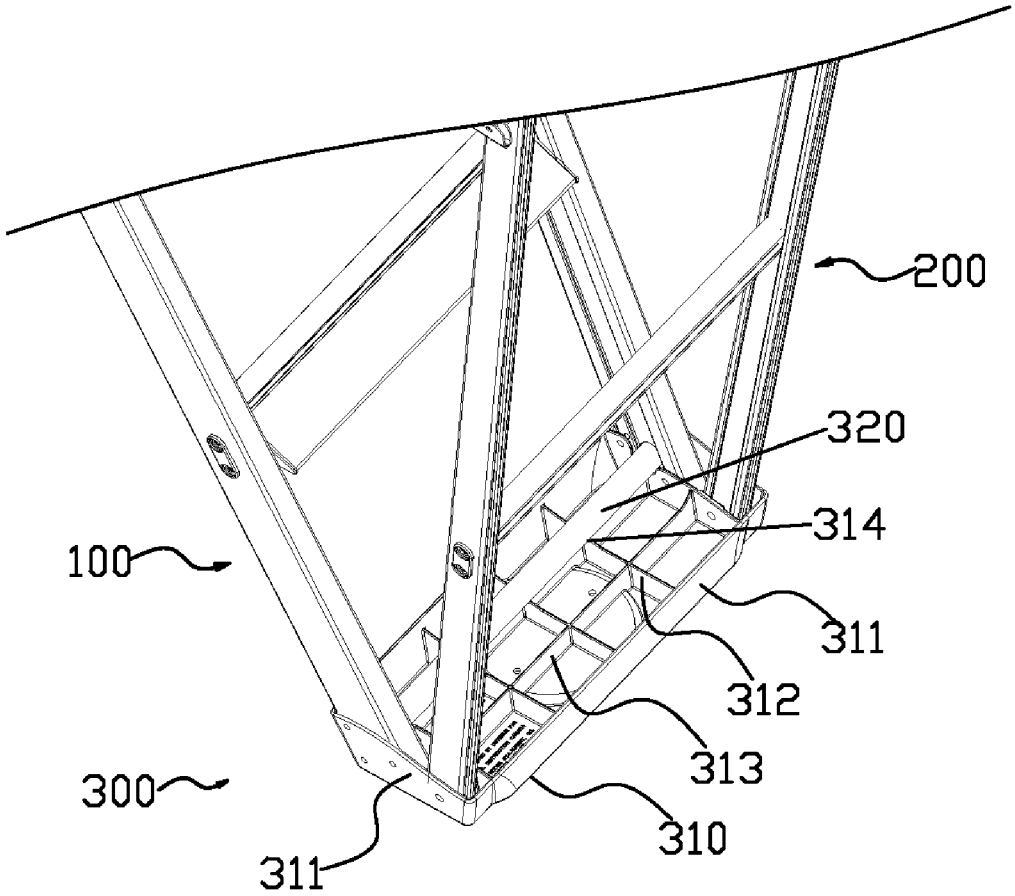
FIG. 3 is a bottom perspective view of the embodiment 1 of the present invention.
Figure 4:
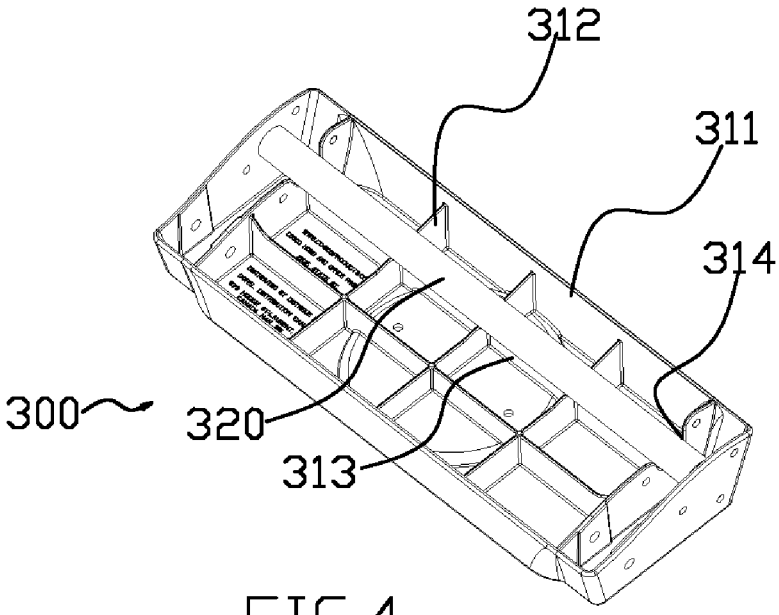
FIG. 4 is a perspective view of the platform in the embodiment 1 of the present invention.

Embodiment 1, Referring to FIG. 1 to FIG. 9, a lambdoidal ladder comprises front struts 100, back struts 200, a platform 300, a hinge 400, treads 500, and connection devices 600.

The treads 500 are disposed between the two front struts 100 via the connection devices 600; back transverse rods or treads 500 are spaced disposed between the two back struts 200; the platform 300 is disposed on the tops of the front strut 100 and the back strut 200; the hinge 400 is H-shaped and is disposed between middles of the front strut 100 and the back strut 200.

Referring to FIG. 1 to FIG. 4, the platform comprises a body 310 and a transverse rod 320. The edges of the body 310 extended downwardly to form a periphery 311. The bottom of the body 310 is formed with a plurality of spaced and parallel transverse reinforcement ribs 312 and a plurality of spaced and parallel lengthwise reinforcement ribs 313, both the transverse and lengthwise reinforcement ribs 312 and 313 are fixedly connected to the periphery 311. Each transverse rib 312 is provided with an orientation slot 314 opened downwardly, these orientation slots 314 are arranged lengthwise to form an orientation groove adapted to the transverse rod 320, and the position of the orientation groove is towards to one of the lengthwise reinforcement ribs 313, The sectional shape of the transverse rod 320 may be round, or other shape such as rectangle or hexagon etc.

The body 310 of the platform 300 is connected to the front struts 100, and the periphery 311 is sleeved to the top ends of the front struts 100. The transverse rod 320 transversely passes through the two front rods of the front struts 100. The transverse rod 320 is supported in the orientation groove of the body, and the end portion of the transverse rod 320, extended out the front struts 100, is inserted into the periphery 311 to form a fixed connection between the platform 300 and the front struts 100.

The back struts 200 are pivotally connected to the bottom of the body 310 and are within the periphery 311 so as to form a pivotal connection between the front struts 100 and the back struts 200.

Figure 5:
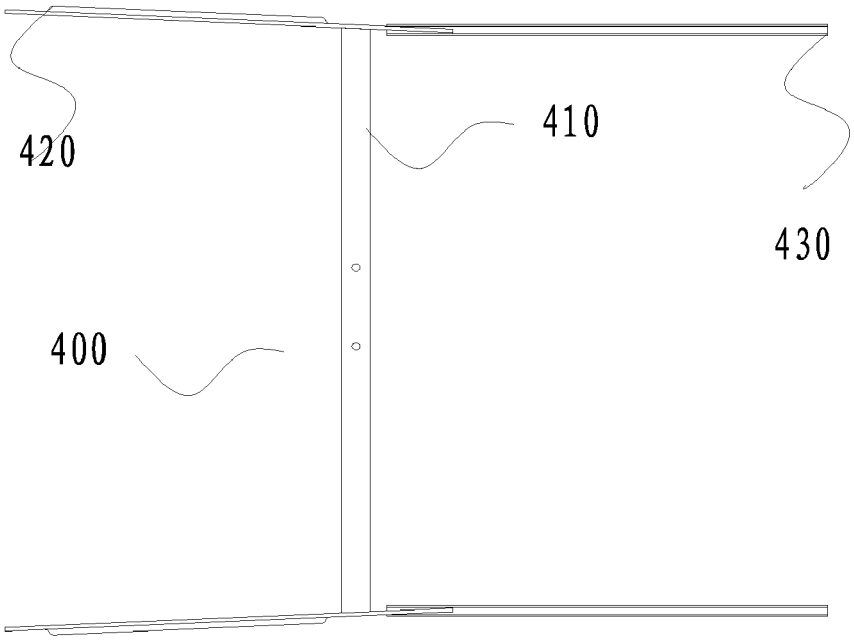
FIG. 5 is a front view of the hinge in the embodiment 1 of the present invention.
Figure 6:
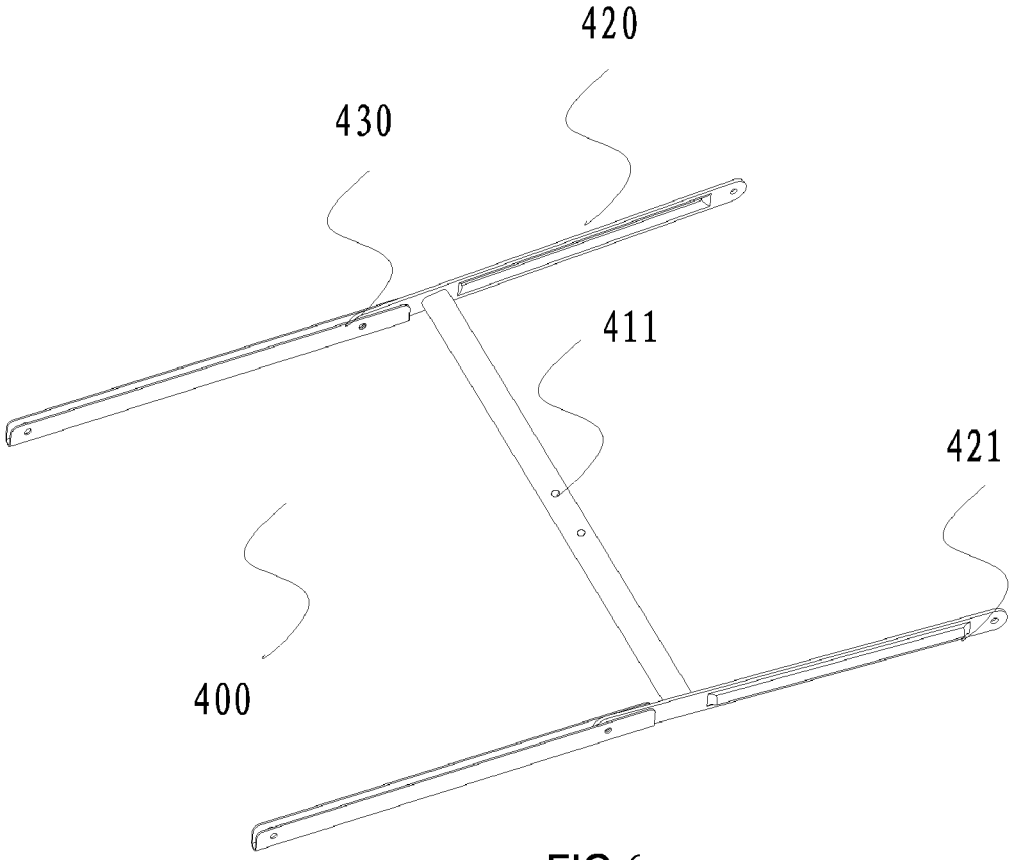
FIG. 6 is a perspective view of the hinge in the embodiment 1 of the present invention.

Hinge 400: referring to FIG. 5 and FIG. 6, the hinge 400 used as a folding device is H-shaped, which comprises a transverse rod 410, a pair of front lengthways rods 420 and a pair of back lengthways rods 430; the back lengthways rods 430 are U-shaped rods, and the back end of the front lengthways rods 420 are respectively inserted between the back lengthways rods 430; the front ends of the front lengthways rods 420 are fixed to the outside of the two front struts 100; the back ends of the front lengthways rods 430 are fixed to the outside of the two back struts 200; the transverse rod 410 is fixed between the two front lengthways rods 410, and the outside of the front lengthways rods 420 are respectively formed orientation protrusions 421, moreover, the transverse rod 410 is provided with a handle portion 411 in the middle. The hinge 400 is used to let the lambdoidal ladder to be in a stable unfolded status. In folding of the lambdoidal ladder, draw downwardly of the handle portion 411, let the back ends of the front lengthways rods 420 free from the back lengthways rods 430, the front rods 420 and the back rods 430 rotated relative to each other until the protrusion 421 of the outside of the front lengthways rods 420 are abut against the back lengthways rods 430. And drive the back struts 200 to rotate relative to the platform 300 to near to the front struts 100.

Figure 7:
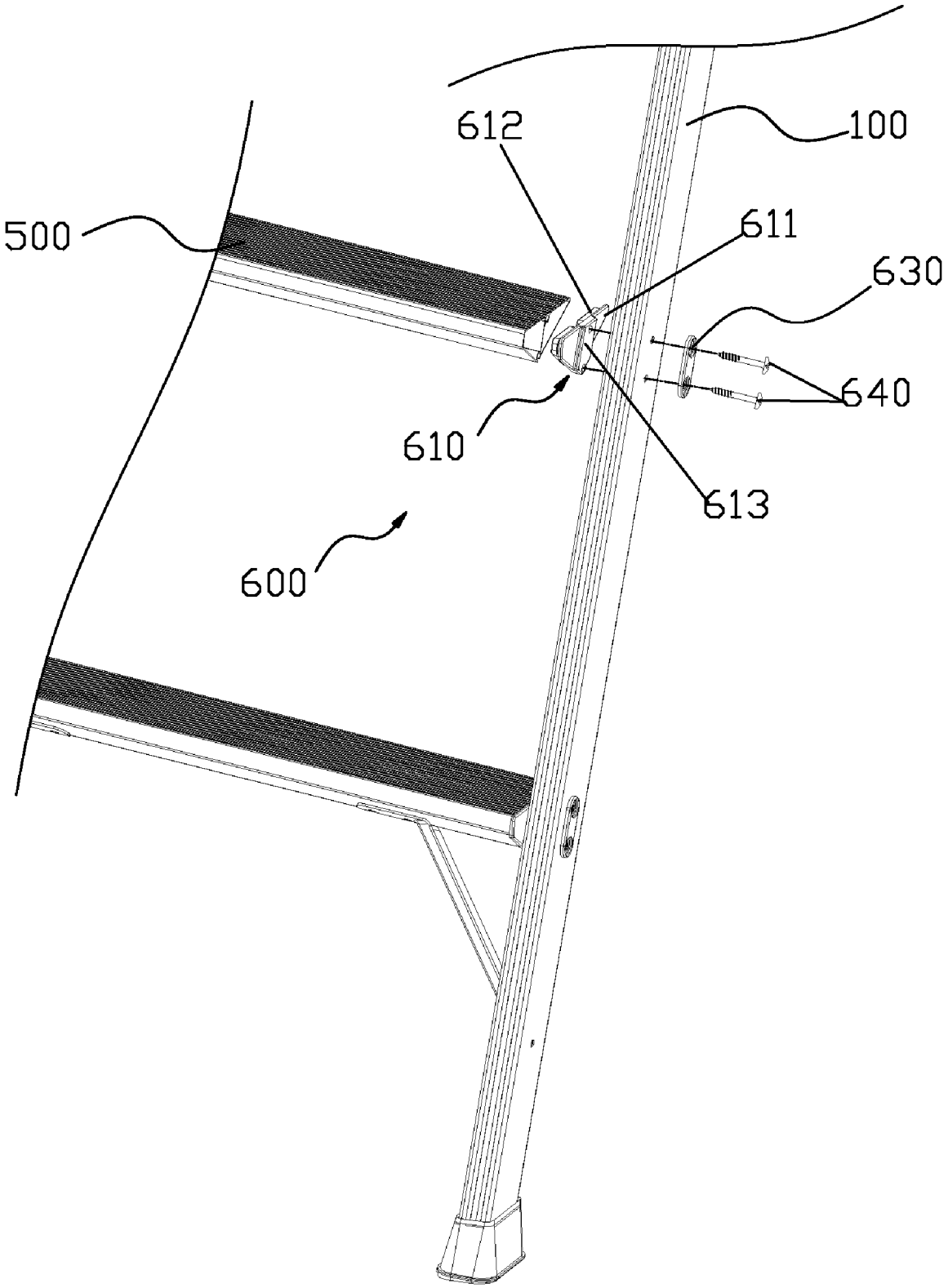
FIG. 7 illustrates the connection portion of the tread in embodiment 1 of the present invention.
Figure 9:
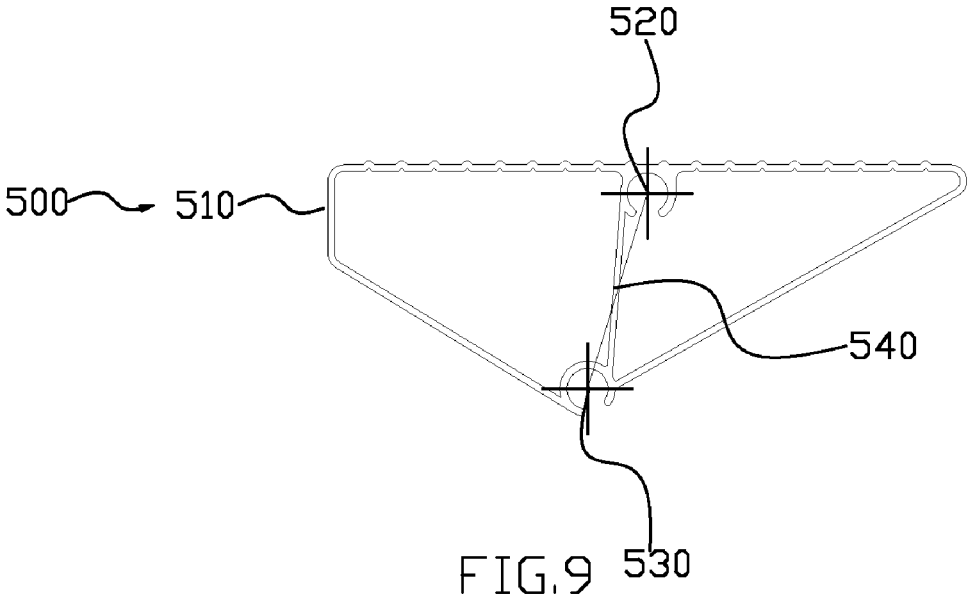
FIG. 9 is a sectional view of the tread in embodiment 1 of the present invention.

Treads 500: referring to FIG. 7 and FIG. 9, each hollow tread 500 comprises a body 510 which has a triangle section comprising a top board and two lower boards. An axial clamping reinforcement opening 520 is disposed in the middle of the bottom of the body 510, and an axial reinforcement clamping opening 530 is disposed in the angle of the two lower boards, an reinforcement piece 540 is disposed between the two reinforcement opening 520, 530, thus the inner hole of the hollow tread 500 is separated into two parts by the reinforcement piece 540. Detailed structure of the treads 500 can be seen in the prior patent of the present inventor in ZL200520126388.6.

Figure 8:
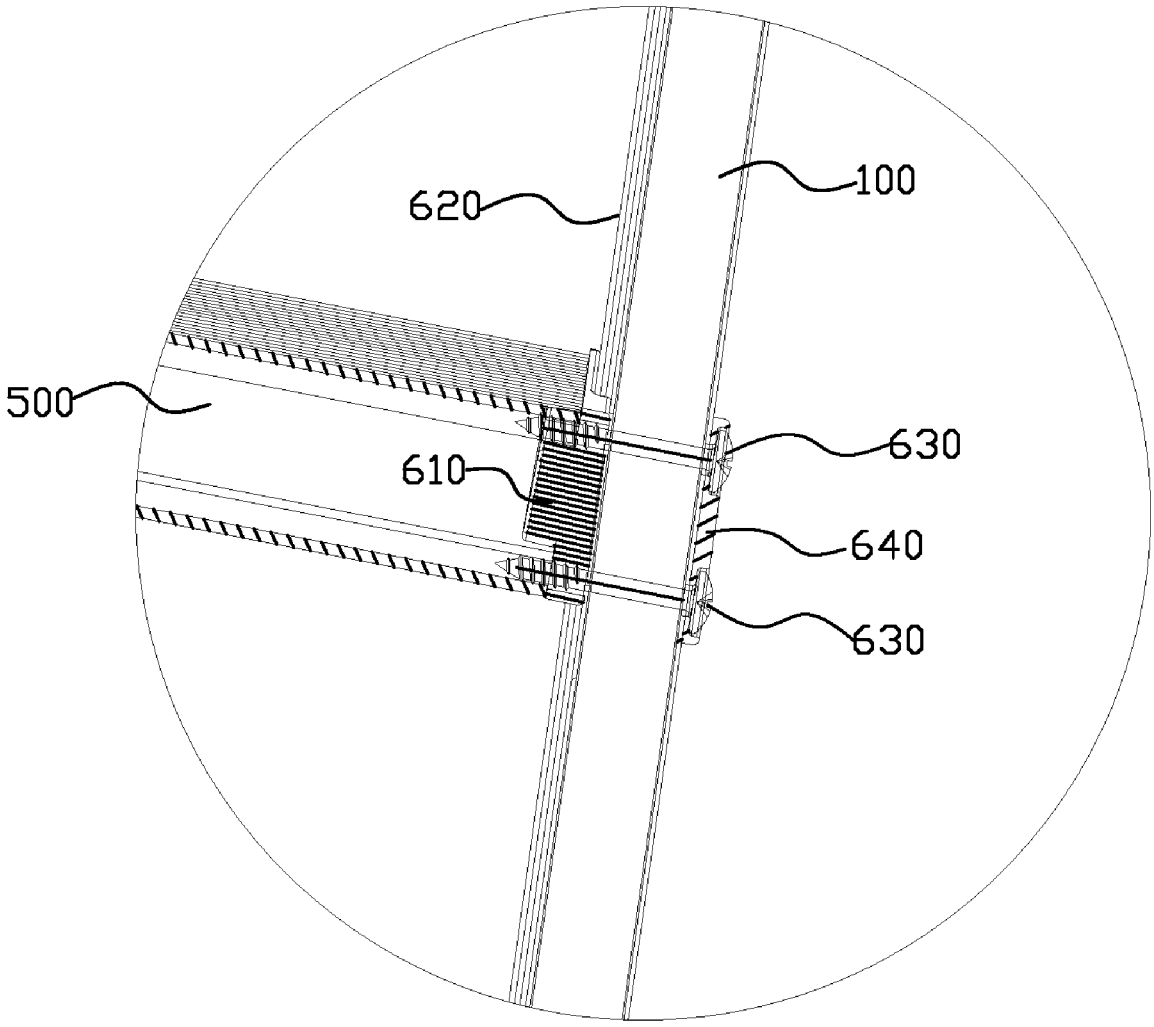
FIG. 8 is a partial enlarged view of FIG. 7

Connection device 600: referring to FIG. 7 and FIG. 8, the connection device 600 comprises a connection element 610, a lengthways groove 620, a gasket 630 and a locking element 640. The lengthways groove 620 is axially disposed in the inner side of the front strut 100.

The connection element 610 comprises a middle piece 611, an insertion portion 612 and a protrusion 613, which are made by one-piece-processing technology. The back side of the insertion portion 612 is fixed to the front side of the middle piece 611, the structure of the insertion portion 612 comprising two separated portions is matching to the shape of the inner hole of the hollow tread 500. The front portion of the protrusion portion 613 is fixed to the back side of the middle piece 611, the protrusion 613 is a bar-shaped protrusion matching with the lengthways groove 612. Herein the middle piece 611 comprises a front extending side extended out the insertion portion 612 and a back extending side extended out the protrusion 613.

The insertion portion 612 of the connection element 610 is inserted into the inner hole of the hollow treads 500 (the two independent portions respectively inserted into the two corresponding portions of the inner hole), the protrusion 613 of the connecting element 610 fixedly inserted into the lengthways groove 620, and the front extending side of the middle piece 611 is abut against the end of the hollow tread 500, the back extending side is abut against the front strut 100. Because the inner part of the hollow tread 500 is separated into two parts, thus the insertion portion and the hollow tread can not be rotated relative to each other. According to requirement, the connection between the protrusion 613 and the lengthways groove 620 is interference fit.

The gasket 630 is abut against the outside of the front strut 100. The locking element comprises two tapping screws arranged up and down, and the locking end of the tapping screw is pass through the gasket 630, the front strut 100, the lengthways groove 620 and the protrusion 610 of the connecting element 610 in turn, then inserted into the reinforcement opening. Herein the friction force between the gasket and the front strut can bear part of the shearing force so as to protect the strut.

Figure 10:
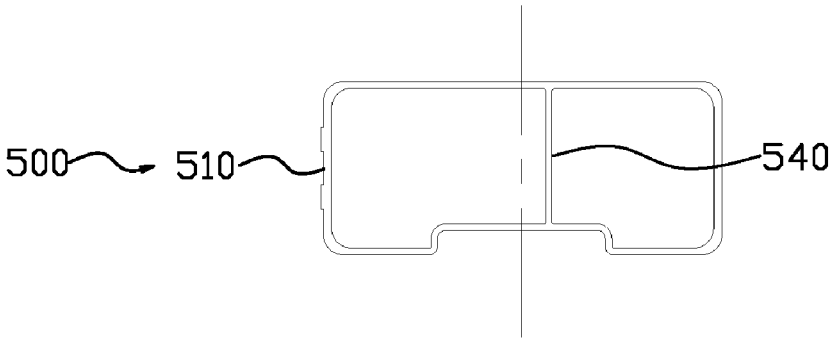
FIG. 10 is a sectional view of the tread in embodiment 2 of the present invention.

Embodiment 2, referring to FIG. 10, the difference of this embodiment to embodiment 1 is that: the hollow tread 500 comprises a body 510 and a reinforcement board 520, the body 510 is a shape similar to a rectangle comprising an upper board and a lower board, the reinforcement board 540 is connected between the upper board and the lower board of the body 510.

Figure 11:
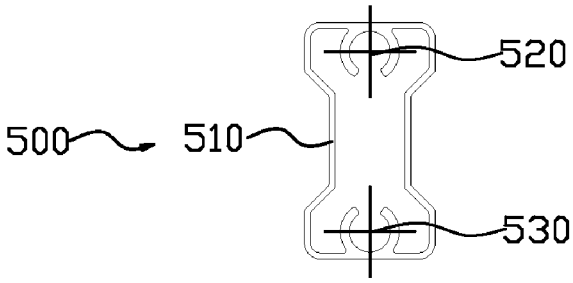
FIG. 11 is a sectional view of the tread in embodiment 3 of the present invention.

Embodiment 3, referring to FIG. 11, the difference of this embodiment to embodiment 2 is that: the hollow tread 500 comprises a body 510, the body 510 is a shape similar to a rectangle comprising an upper board and a lower board, two axial reinforcement openings 520 and 530 are respectively disposed in the middles of bottom side of the upper board and the upper side of the lower board.

Figure 12:
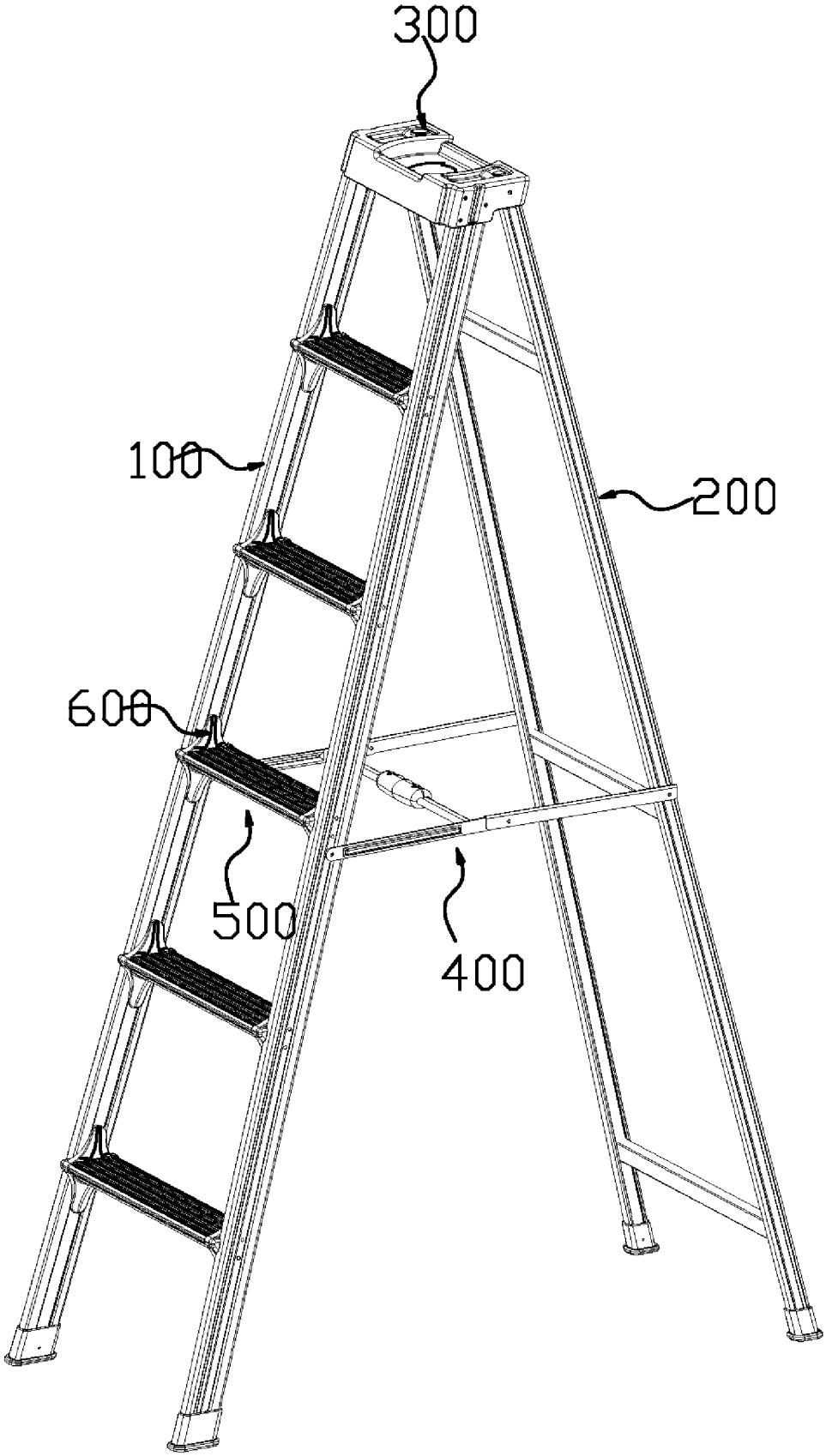
FIG. 12 is a perspective view of the embodiment 4 of the present invention.
Figure 13:
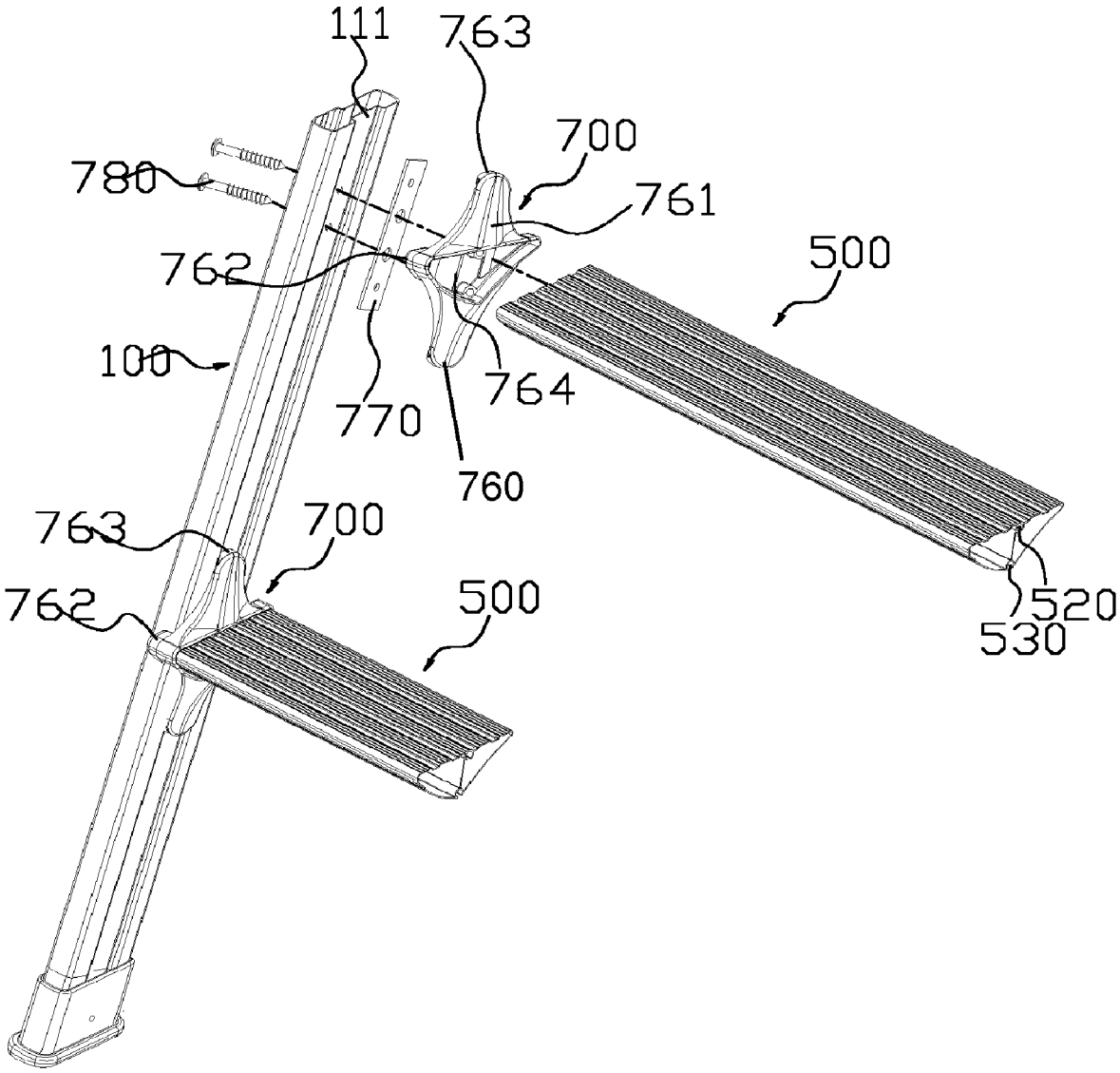
FIG. 13 is a partial enlarged perspective and exploded view of the embodiment 4 of the present invention.
Figure 14:
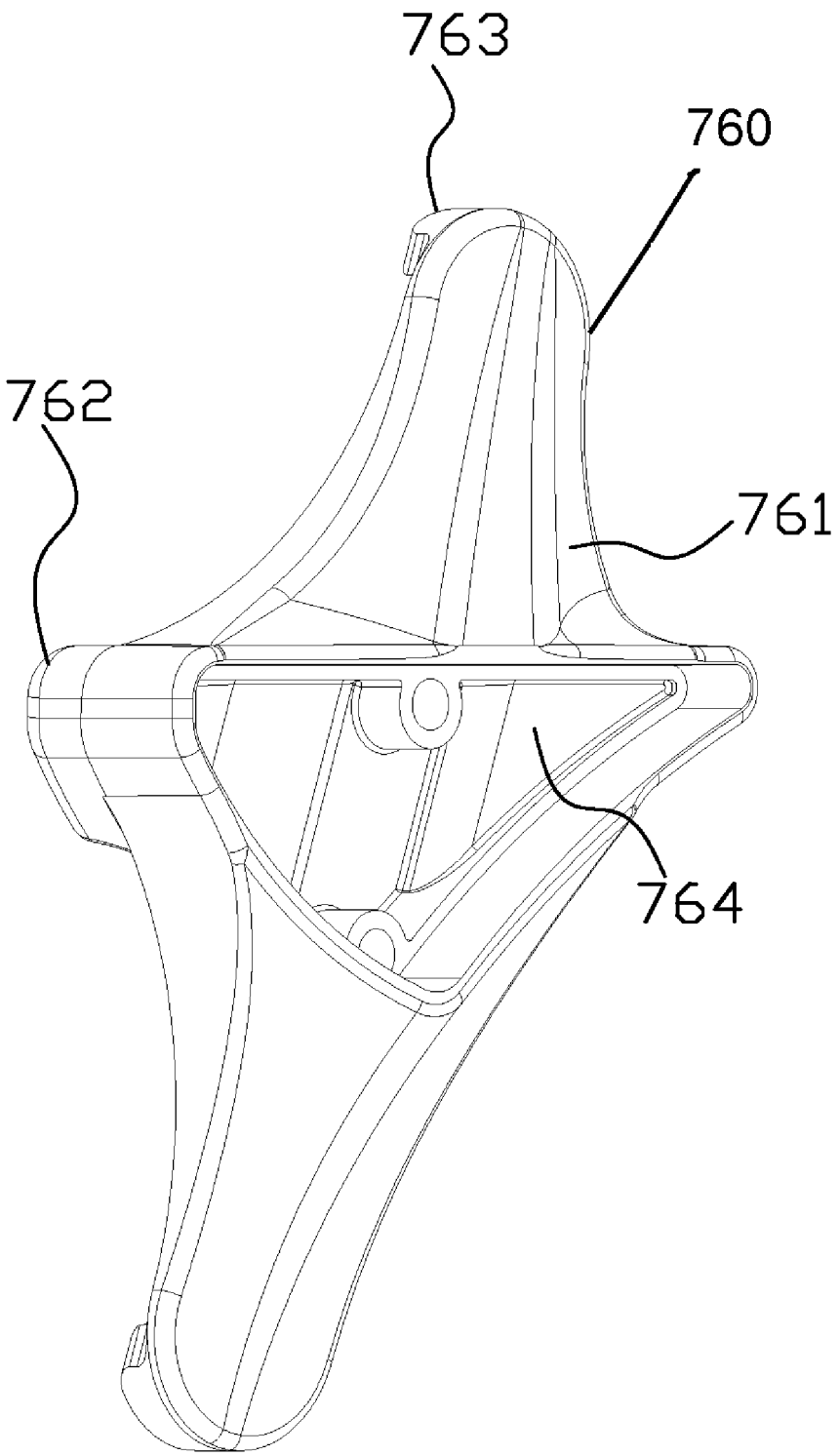
FIG. 14 is a perspective view of the connection element in the embodiment 4 of the present invention.

Embodiment 4, Referring to FIGS. 12, 13 and 14, the difference of this embodiment to embodiment 1 is that the connection device between the tread 500 and the front strut 100 is different.

Connection device 700: comprises a connection element 760, a reinforcement gasket 770 and a locking bolt 780. The connection element 760 comprises a base 761 with a cross shape, two protrusions 762 respectively disposed on the left side and right side and extended backwardly, and two middle portions 763 respectively fixed the up and lower portions of the base 761 and extended out the base 761. The base 761 has a orientation groove 764 which opened forwardly, the shape of the section of the orientation groove 764 is matching with the shape of the end of the tread 500.

Referring to FIG. 9 and FIG. 12, the end portion of the tread 500 is positioned in the groove 764 of the connection element 760. The back side of the base 761 abuts against and fixed to the first side of the front strut 100 via the reinforcement gasket 770, the two protrusions 762 respectively abut against the two second sides (left and right sides) near to the first side of the front strut 100, the middle element 763 is inside the middle groove 111 and form a tight fit. The reinforcement 770 is positioned in the middle groove 111 and fixed between the connection element 760 and the front strut 100. Bolts 780 pass through the front strut 100 and the connection element 760 and inserted into the opening 520 of the tread 500 by the bolting end.

The invention also can be a single-side lambdoidal ladder. i.e. treads are disposed between the two front struts, and supporting rods are disposed between the two back struts; or two-side lambdoidal ladder, i.e. treads are disposed both between the two front struts and the two back struts.

Industrial Applicability

The lambdoidal ladder of the present invention comprises front struts, back struts, treads, a folding device, a connection device and a platform. the platform comprises a body and a transverse rod which goes through the front strut, an orientation slot matching to the transverse rod is set under the body; the folding device fixed to the middle part of the front strut and the back strut is constructed a hinge with a H figuration; the tread is fixed to the front and back struts by the connection device. the invention has simple structure, well working effect and high strength.

What is claimed is:

1. A lambdoidal ladder comprising:

a pair of front struts;

a pair of back struts;

a plurality of treads;

a plurality of connection devices fastening the plurality of treads between the pair of front struts;

a folding device having an H-shaped hinge, the folding device attached to a respective middle part of the pair of front struts and the pair of back struts; and a platform comprising a body and a transverse rod, the body having a bottom and an edge, the edge extending downwardly to form a periphery, the transverse rod passing through respective top ends of the pair of the front struts and joining the periphery, the bottom having a plurality of transverse reinforcement ribs, each of the transverse reinforcement ribs having an orientation slot, the plurality of the orientation slots forming an orientation groove having the transverse rod within the groove, the plurality of transverse reinforcement ribs joining the periphery, wherein the front struts are fixed to the bottom of the platform and the back struts are pivotally connected to the bottom of the platform resulting in a pivotal connection between the front struts and the back struts.

2. The lambdoidal ladder according to claim 1, wherein the bottom further has a plurality of lengthwise reinforcement ribs.

3. The lambdoidal ladder according to claim 1, wherein said periphery covers the top ends of said pair of front struts.

4. The lambdoidal ladder according to claim 1, wherein said H-shaped hinge comprises a second transverse rod, a pair of front lengthways rods and a pair of rear lengthways rods, wherein said rear lengthways rods are U-shaped rods, wherein rear ends of said front lengthways rods are inserted into said rear lengthways rods, wherein front ends of said front lengthways rods are fixed to an outside of the pair of the front struts, wherein rear ends of the pair of the rear lengthways rods are fixed to an outside of the pair of the rear struts.

5. The lambdoidal ladder according to dam 1, wherein each of said plurality of connection devices has a connection element, a first side of said connection element being joined to an end of one of said plurality of treads, a second side of said connection element being joined to one of the pair of front struts, and said connection element being locked by a locking element passing through the one of the pair of front struts.

6. The lambdoidal ladder according to claim 5, wherein the first side of said connection element is provided with an orientation groove, an inner edge of said connection element matching an outer edge of the end of one of said plurality of treads, the end of one of said plurality of treads being positioned and supported inside said orientation groove, and said connection element being fixed to the one of the pair of front struts.

7. The lambdoidal ladder according to claim 6, wherein said connection element includes a base and two protrusions on the second side of said connection element, wherein said two protrusions respectively abut against two sides of the one of the pair of front struts.

8. The lambdoidal ladder according to claim 7, wherein a first side of said one of the pair of front struts is concaved to form a middle groove, said base is protruded backwardly to form a middle element, said middle element is disposed inside of said middle groove.

9. The lambdoidal ladder according to claim 5, wherein said connection element includes a middle piece having the first side and the second side, an insertion portion and a protrusion portion, said insertion portion being located on the first side of said middle piece, and said protrusion portion being located on the second side of said middle piece.

10. The lambdoidal ladder according to claim 9, wherein said connection element has an integrated structure; said middle piece has a front protrusion extending from said insertion portion; said insertion portion is inserted into an inner side of said one of the plurality of treads.

11. The lambdoidal ladder according to claim 9, wherein said middle piece has a back extending side extending from said protrusion portion, said protrusion portion being inserted into a lengthwise groove of said one of the pair of front struts, said back extending side abutting against said one of the pair of front struts.

* * * * *